United States Patent [19]

Belokin et al.

[11] Patent Number: 4,949,486

[45] Date of Patent: Aug. 21, 1990

[54] DISPLAY UNIT COMPRISING SIMULATED FLYING OBJECT DRIVEN BY AUTOMATICALLY REVERSIBLE ELECTRIC MOTOR

[75] Inventors: Martin P. Belokin; Paul Belokin, Jr., both of Denton, Tex.

[73] Assignee: Martin Paul, Inc., Denton, Tex.

[21] Appl. No.: 306,829

[22] Filed: Feb. 3, 1989

[51] Int. Cl.[5] ..... A63H 13/20

[52] U.S. Cl. ..... 40/414; 40/417; 446/30

[58] Field of Search ..... 40/414, 411, 431, 429, 40/430, 431, 614, 417, 613, 614; 272/8 D, 8 P; 446/236, 30, 247

[56] References Cited

U.S. PATENT DOCUMENTS

| | | | |
|---|---|---|---|
| 663,614 | 12/1900 | Riedmuller | 40/411 |
| 2,528,268 | 10/1950 | Dickinson | 446/30 |
| 2,779,595 | 1/1957 | Ensley | 446/30 |
| 3,477,157 | 11/1969 | Paquette | 40/429 |
| 3,494,058 | 2/1970 | Paquette | 40/614 |
| 3,736,683 | 6/1973 | Paquette | 40/429 |
| 3,888,030 | 6/1975 | Bradt | 40/411 |
| 4,180,932 | 1/1980 | Millard | 40/411 |

*Primary Examiner*—Kenneth J. Dorner
*Assistant Examiner*—J. Hakomaki
*Attorney, Agent, or Firm*—Nilles & Nilles

[57] ABSTRACT

A display unit for point of sale advertising comprises a stationary object, such as a real or simulated flowering plant, mounted on a support, such as a flowerpot, and a flying object, such as a simulated butterfly, operated by driving apparatus so as to move in a randomly undulating and randomly reversible orbit around the plant, as would a real butterfly. The driving apparatus comprises an electric motor having a motor housing stationarily mounted on the flowerpot, a stator including a stationary field coil electrically energizable by alternating current mounted in the motor housing, and a rotor in the form of a bipolar permanent magnet rotatably mounted on an upright magnetizable metal shaft on the motor housing. The driving apparatus further comprises a thin resiliently flexible length of piano wire having its lower end mechanically connected to and rotatable by the permanent magnet rotor and having the simulated butterfly mechanically connected to its upper end. In operation, energization of the field coil produces a magnetic field which causes the permanent magnet rotor, the wire and the simulated butterfly to rotate in one direction. However, a predetermined mechanical load imposed on the permanent magnet rotor effected by random striking of the simulated butterfly against the plant, or by random horizontal and vertical excursions of the simulated butterfly in its orbital path, or by random "hand-up" of the permanent magnet rotor on its shaft, causes the rotor to periodically and frequently reverse its direction of rotation. The resultant effect is to cause the simulated butterfly to flutter about the flowering plant as would a real butterfly.

26 Claims, 3 Drawing Sheets

DISPLAY UNIT COMPRISING SIMULATED FLYING OBJECT DRIVEN BY AUTOMATICALLY REVERSIBLE ELECTRIC MOTOR

BACKGROUND OF THE INVENTION

1. Field of Use

This invention relates generally to a display unit, usable for advertising or amusement purposes, for example, which comprises a relatively stationary object, such as an actual or simulated flowering plant, and a flying object, for example, such as a simulated flying creature in the form of a butterfly, hummingbird or flying insect, which flying object is driven by an electric motor in an undulating orbit relative to the stationary object and exhibits a reversal in the direction of orbit in response to periodic random collision with the stationary object or to periodic random excursions relative to the stationary object.

2. Description of the Prior Art

U.S. Pat. No. 4,180,932, issued Jan. 1, 1980, entitled "Animated Plant Display", discloses butterflies mounted on wires which are secured to a housing. A platform adjacent the wires rotates while the wires themselves are stationary and do not rotate. As the platform rotates, it successively strikes the wires to cause vibrations in the wires and in the simulated butterfly. It does not rely on centrifugal force and rotative wire movement to direct the butterfly in an annular path, but rather the butterfly movement is constrained to a straight line.

U.S. Pat. No. 3,477,157, issued Nov. 19, 1969, entitled "Advertising Display", shows a device simulating a firefly mounted on a flexible support which in turn is anchored in an angularly oriented flippable holding member. The member is attached to a rotatable shaft having a loose connection and imparts a jerking motion on the member. However, the angular movement in this device is not as a result of centrifugal force, but is an irregular movement caused by the loose connections and the type of flippable holding member to which a steel spring is attached.

Our co-pending U.S. application Ser. No. 241,357, filed Sept. 4, 1988, now U.S. Pat. No. 4,901,458, which issued Feb. 20, 1990 utilizes a battery operated drive means and is not reversible as to its direction of rotation, and an eccentric mounting of the wire is used to impart a particular flight pattern for the insect.

SUMMARY OF THE PRESENT INVENTION

A display unit in accordance with the present invention comprises a support, a relatively stationary object mounted on the support, a flying object, and means mounted on the support and connected to the flying object and operable to effect movement of the flying object in an undulating and reversible orbit relative to the stationary object.

In the preferred embodiment disclosed herein, the support takes the form of a simulated flowerpot, the stationary object takes the form of a simulated flowering plant, and the flying object takes the form of a simulated butterfly.

The means to effect movement of the flying object comprise an electric motor having a housing, a stator and a rotor, and an elongated small-diameter, flexible, resilient member, such as a fine, tempered, piano wire, connected between the rotor and the flying object. The stator comprises a plurality of magnetizable poles and a field coil which, when energized with alternating current, provides a rotating magnetic field. The rotor comprises a multipolar permanent magnet which is mounted for rotation in the magnetic field on a magnetizable metal shaft which is affixed to the motor housing.

The flexible resilient wire has one end connected to the rotor and has its other end extending upwardly and connected to the flying object so that rotation of the rotor effects rotation of the wire and the flying object moves in an orbital path relative to the stationary object. In the preferred embodiment, wherein the stationary object takes the form of a simulated flowering plant, the wire extends upwardly through the center of the plant stalks and the weight of the flying object causes the upper portion of the wire to bend downwardly so that the orbit is generally located around the upper end of the plant.

The electric motor is of such a type that, when a mechanical load of a predetermined value is imposed on the rotor which exceeds the rotational force provided by the motor, the rotor slows down and "slipping" occurs. Such "slipping" causes the magnetic poles of the permanent magnet rotor to shift out of phase with the rotating field of the stator. As a result, when the load is removed and if the poles are still out of phase, the rotor is then caused to rotate in the reverse direction of its former rotation.

The creation and modification of the mechanical load referred to can result, for example, from any one or any combination of the following factors: striking of the flying object against a portion of the stationary object (i.e., a portion of a plant stalk or its flower; incursion or excursion of the flying object relative to the axis of rotation of the rotor (i.e., a change in the moment arm of the object) which can result from such striking or from acceleration or deceleration in rotor speed; reversal of the direction of rotation of the rotor; or manual interference with the flying object.

In any case, the orbital path defined by the flying object undulates relative to a horizontal plane so as to vary in diameter and in shape (i.e., circular to eliptical, for example) and undulates vertically. As a result, the flying object exhibits random and reversible motions in a random path and appears to be flying, fluttering and hovering in a natural manner relative to the stationary plant. The tendency of the rotor magnet to randomly and periodically "hang up" on the mangetizable metal shaft on which it is rotatably mounted, also contributes to the hovering effect.

Another more limited aspect of the above invention relates to the uppermost end of the wire having a mounting pad fixed thereto, and a low tack adhesive is on said pad, whereby said flying object can be easily removably attached to said pad so as to be replaceable by another type of flying object.

Still another aspect of the above invention relates to the support having a central bore defining a vertically extending opening, and the motor is removably mounted in the opening and has sponge-like pad means around its periphery for engagement with the wall of the bore to cushion the motor in the opening and reduce vibration.

Still another aspect of the above invention is that the support is a simulated flowerpot formed of Styrofoam, including stems with flowers inserted in the pot and located around the motor; whereby said butterfly swings around the flowers and can randomly and occasionally contact the flowers to cause an impedance to their movement to consequently cause rotor rotation to be reversed with corresponding rotational reversal of the swinging of the butterfly. Furthermore, an occasional rotational impedance of the butterfly may be caused by a change in the movement arm of the butterfly as it is trailingly rotated by the magnet and thereby causes the rotor of the electric motor to reverse its direction and thereby reverses the rotation of said magnet and attached butterfly.

A display unit in accordance with the present invention has amusement and entertainment value in and of itself but is especially useful to provide a point-of-purchase display in a flower shop or the like to simulate a flying insect such as a butterfly, bee, hummingbird or the like, circling a simulated or real flowerpot.

DESCRIPTION OF A PREFERRED EMBODIMENT

Display units in accordance with the present invention can take various forms and serve various purposes. In the preferred embodiment disclosed herein, the display unit takes the form of a floral display which is adapted to be used in various environments such a flower shops, supermarkets or other retail establishments. Such floral displays are used as point-of-purchase advertisements and are designed to attract the attention of the customers. The preferred embodiment comprises a flying object in the form of an animated wing flying insect, such as a butterfly 50, whose movement around a stationary object, such as a floral arrangement FA, is life-like and readily attracts the attention of the prospective customers.

Figure 2:
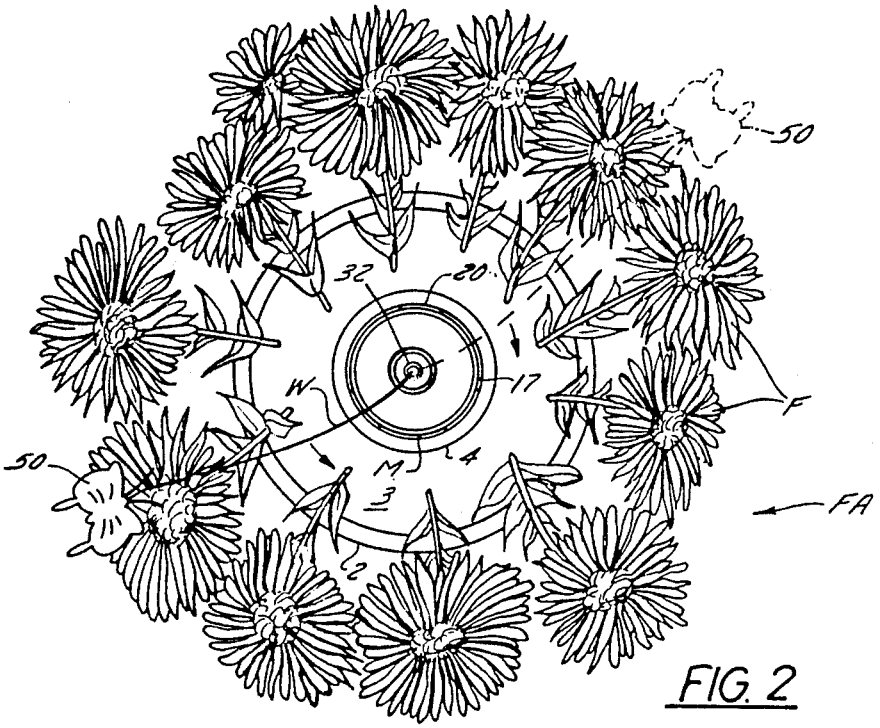
FIG. 2 is a top plan view of the display unit shown in FIG. 1.
Figure 1:
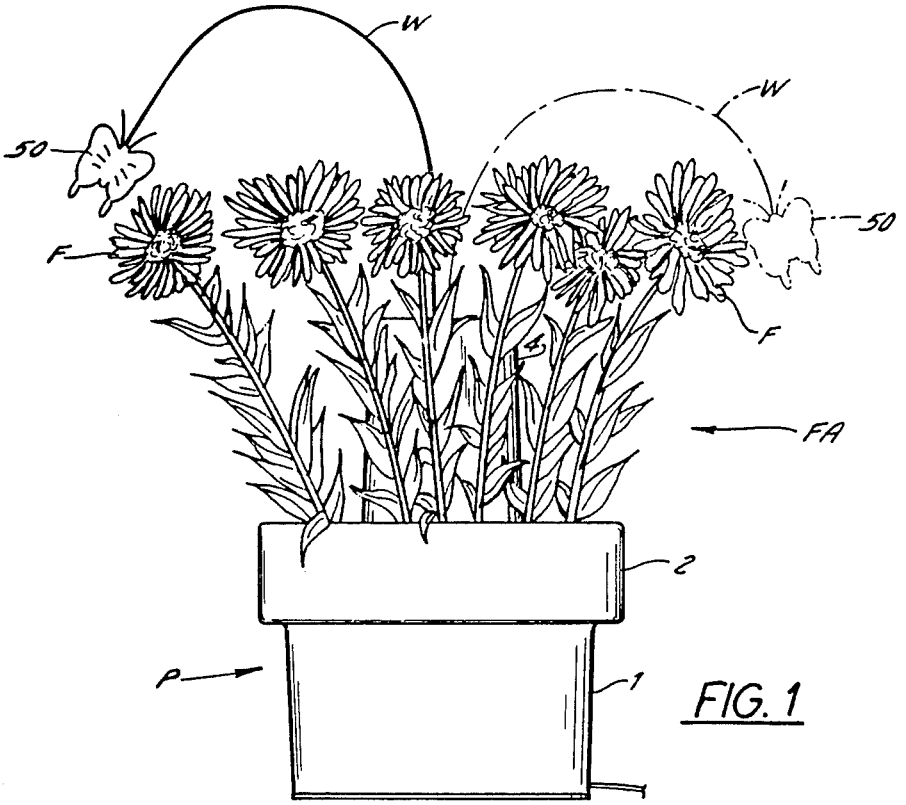
FIG. 1 an elevational view of a display unit in accordance with the present invention.
Figure 3:
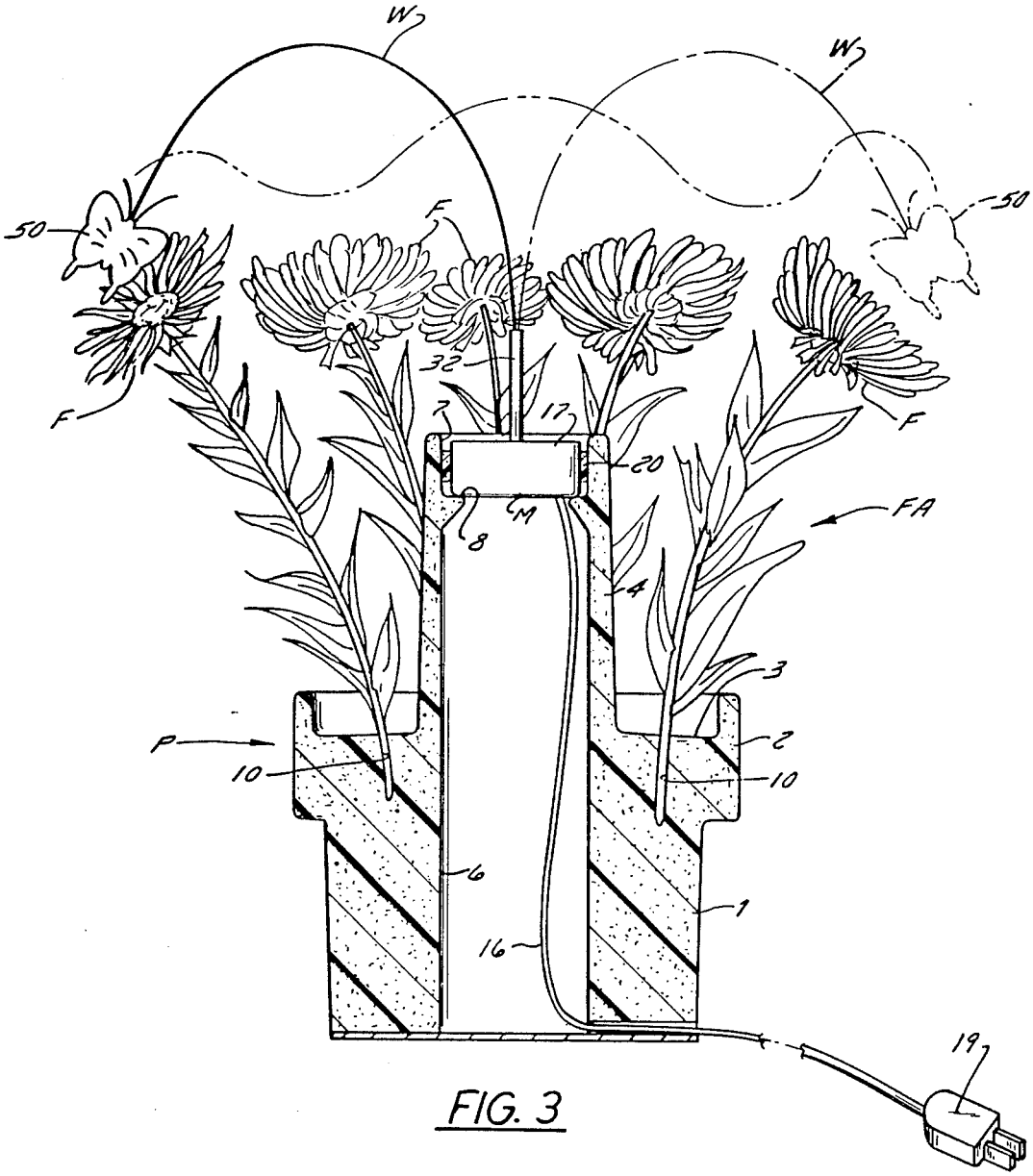
FIG. 3 is an enlarged elevational view, partly in vertical cross section, of the display unit shown in FIG. 1 and showing the electric motor mounted therein.

Referring to FIGS. 1, 2 and 3, the display unit in accordance with the present invention comprises a simulated flowerpot P made from Styrofoam serving as a support and having cylindrical base portion 1, an enlarged intermediate portion 2 having a recessed annular trench or trough 3 therein, and a central upstanding cylindrical portion 4. The support P has a central bore 6 which defines a vertically extending opening 7 at its upper end and an annular projection or ridge 8 is formed around the lower portion of the opening 7 so as to form a seat for an electric motor M, hereinafter described.

A stationary object in the form of a floral arrangement FA is provided around the upstanding portion 4 of flowerpot P and includes a series of flower stems F with blossoms thereon which may be real or artificial and which are inserted in preformed holes 10 located circumferentially around trench or trough 3. The flower stems F, which are preferably slightly flexible, are generally of the same height so their blossoms extend above and conceal the upstanding portion 4 of flowerpot P.

Figures 4, 5, 6:
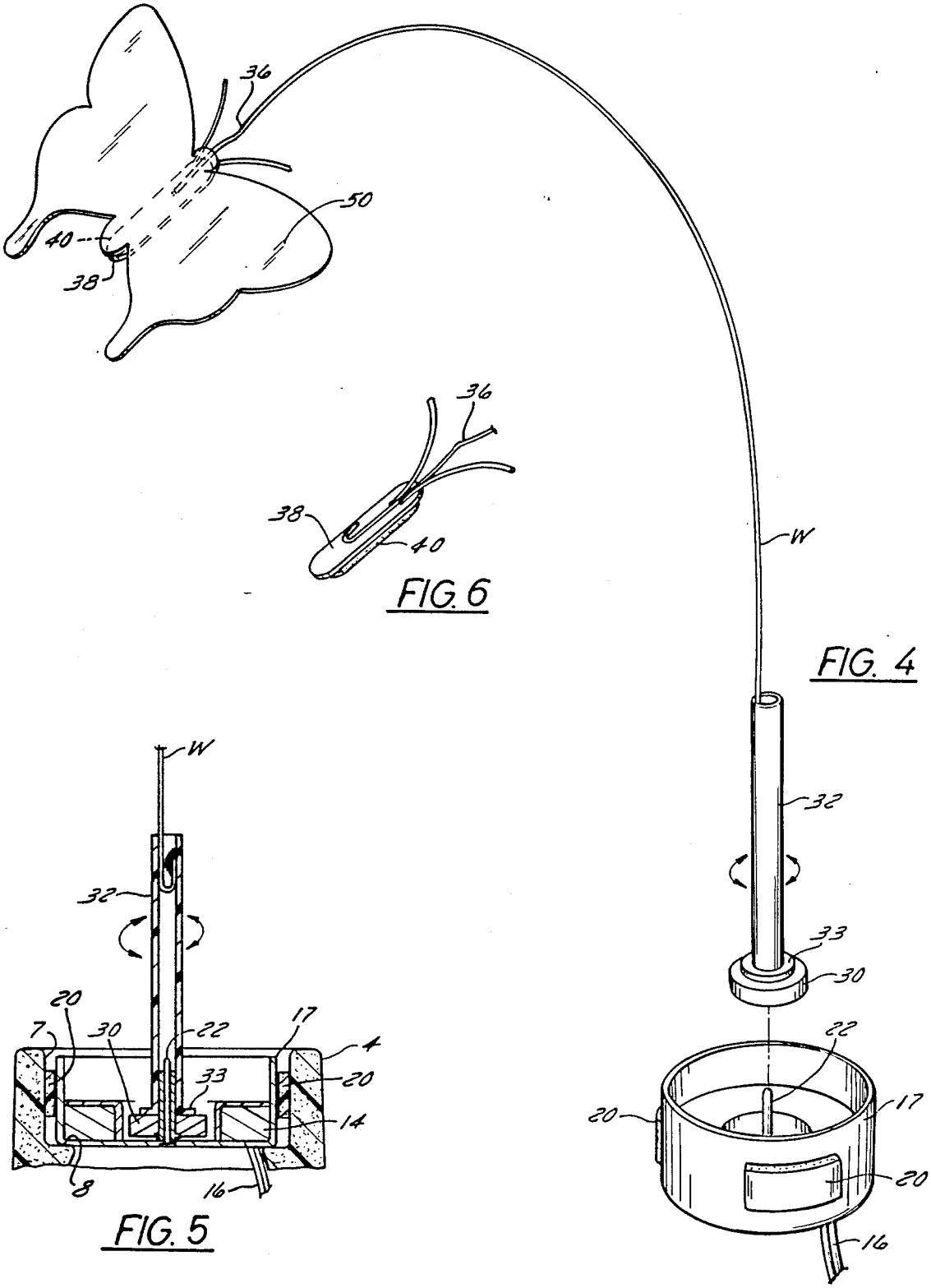
FIG. 4 is an enlarged perspective, exploded view of the electric motor and attached flying object shown in FIG. 3.
FIG. 5 is an enlarged, vertical, cross-sectional view of a portion of FIG. 3 and showing details of the motor.
FIG. 6 is a perspective view of a means for removably attaching the flying object to the upper end of a wire which is attached to the motor.

Referring to FIGS. 4 and 5, electric motor M is an alternating current motor comprising a housing or casing 17, a stator including a field coil 14 that is connectable to a power source through an electric cord 16 and plug 17 and a rotor 30 hereinafter described. The wire in coil 14 is preferably of a size capable of handling about 240 volts but is energized at 110 volts so that it does not overheat. The outer casing 17 of motor M is cylindrical and has sponge-like pad means 20 around its periphery which fills the space between the casing and the interior wall of opening 7.

In an actual working embodiment of the invention, motor M was constructed by modifying a standard clock motor obtained from the Bowman Electric Company of Chicago, Ill. so as to remove a one-way clutch and gears therefrom.

This sponge-like pad means 20 functions to secure motor M in place and to cushion the motor in the flowerpot P so as to dampen vibration and noise. Motor M and its pad means 20 are press-fit into opening 7 and the motor is firmly supported therein. The annular projection 8 around the interior of opening 7 provides a bottom stop for motor M and holds it securely in place. The motor housing 17 has a central, upstanding, magnetizable metal shaft 22 fixed centrally therein which is stationary and does not rotate. Shaft 22 provides support for the rotating permanent magnet 30 and its assembly now to be described.

The motor rotor 30 takes the form of a permanent magnet and has north and south poles. An upstanding plastic member or tube 32 is secured by its lower flange 33 to the upper surface of magnet 30, as by being glued or otherwise fastened thereto. The plastic tube 32 extends well above the upper end of flowerpot P.

An elongated, small-diameter, flexible, resilient member, such as a piano wire W, is secured at its lower end to and within the upper end of plastic tube 32 (FIG. 5) so that magnet 30, tube 32 and wire W all rotate together on the fixed shaft 22. This rotation can be in either direction.

Referring to FIGS. 4 and 6, at the upper or free end 36 of wire W is secured a sponge-like member 38 which has a low-tack adhesive 40 on one side. The simulated insect, such as butterfly 50, can be easily and replaceably attached to the adhesive 40 at the end of wire W. It will be noted that butterfly 50 is of full and realistic configuration and its wings are at a dihedral angle of about 10° to simulate an actual butterfly, even when it is not moving.

When in operation, the magnet rotor 30 of motor M rotates wire W and butterfly 50 thereon and in doing so, the butterfly orbits or swings around the floral arrangement FA in a fluttering action. Periodically and frequently, butterfly 50 is caused to reverse its rotational direction, as well as assume an undulating path of movement in both a horizontal and a vertical direction. This reversal of rotation of the butterfly is caused, for one thing, because of the trailing motion of the butterfly and its weight which periodically causes the alternating current motor to reverse its direction, thereby reversing the direction of the butterfly movement. Another impedance of the movement of the butterfly, such as when it strikes a flower, will also cause the motor M to reverse its direction. In this manner the butterfly is caused to rapidly, erratically and unpredictably reverse its direction and its path and movement of travel, thus giving a very life-like movement and appearance to the butterfly as it flits about the flowers.

In the embodiment depicted herein, a single butterfly 50 on single wire W is connected to be driven by permanent magnet rotor 30. However, a plurality of wires W, each having a butterfly 50 or other flying object thereon, could be connected to be driven by a single magnet rotor 30 and these flying objects could be circumferentially spaced apart from each around the magnet rotor.

Furthermore, in the embodiment depicted, the flying object takes the form of a winged insect orbiting a real or simulated floaral arrangement. If preferred, however, the flying object could take some other form, such as a miniature airplane or helicopter orbiting a relatively stationary object such as a miniature airport control tower, racing pylon or other obstruction.

It is to be understood that after the dispensing unit runs for awhile, the metal shaft 22 in the motor M becomes magnetized by the permanent magnet rotor 30 and this adds another desirable motion to the object 50.

Rotational motion of rotor 30 stops periodically because of the magnetic interaction between shaft 22 and rotor 30 which causes friction as the rotor 30 "window-locks" or "hangs up" on the shaft and the butterfly lands on a flower or stands still for a moment and allows the viewer to see its markings and color.

Other motions can come about by changing the size, shape and weight of the butterfly 50.

I claim:

1. A display unit comprising:

a support;

a flying object;

and means mounted on said support and connected to said flying object, said means being operable to effect reversible orbital movement of said flying object relative to said support; said means comprising:

an electric motor comprising a stator and a rotor;

and an elongated, small-diameter, flexible, resilient member secured between said rotor and said flying object;

said motor being operable in response to a predetermined mechanical load imposed on said rotor resulting from a variation in the movement of said flying object to effect a reversal in the direction of rotation of said rotor and said flying object.

2. A display unit according to claim 1 wherein said means is further operable to effect undulating movement of said flying object relative to said support.

3. A display unit according to claim 1 including a relatively stationary object on said support and wherein said variation in movement of said flying object is effected by collision of said flying object with said stationary object or by undulating movement of said flying object.

4. A display unit according to claim 1 comprising means for rotatably supporting said rotor and wherein said predetermined mechanical load further results from periodic speed-reducing frictional engagement between said rotor and said means for rotatably supporting said rotor.

5. A display unit according to claim 4 wherein said rotor comprises a permanent magnet and said means for rotatably supporting said rotor is a shaft made of mangetizable material.

6. A display unit according to claim 3 wherein said support comprises a flowerpot, wherein said stationary object takes the form of a plant, and wherein said flying object takes the form of a simulated flying creature, such as a bird, butterfly or other flying insect.

7. A display unit according to claim 1 further including means for releasably securing said flying object to said flexible resilient member.

8. A display unit comprising:

a support;

a stationary object mounted on said support;

a flying object;

and means mounted on said support and connected to said flying object, said means being operable to effect reversible orbital movement of said flying object relative to said stationary object, said means comprising:

an electric motor comprising a stator and a rotor;

and an elongated, small-diameter, flexible, resilient member secured between said rotor and said flying object;

said motor being operable in response to a predetermined mechanical load imposed on said rotor resulting from variations in the movement of said flying object to effect a reversal in the direction of rotation of said rotor.

9. A display unit according to claim 8 wherein said means is further operable to effect undulating movement of said flying object relative to said stationary object.

10. A display unit according to claim 8 wherein said variations in movement of said flying object are effected by collision of said flying object with said stationary object or by undulating movement of said flying object.

11. A display unit according to claim 8 comprising means for rotatably supporting said rotor and wherein said predetermined mechanical load results from periodic frictional engagement between said rotor and said means for rotatably supporting said rotor.

12. A display unit according to claim 11 wherein said rotor comprises a permanent magnet and said means for rotatably supporting said rotor is a shaft made of mangetizable material.

13. A display unit according to claim 8 wherein said support comprises a flowerpot, wherein said stationary object takes the form of a plant, and wherein said flying object takes the form of a simulated flying creature, such as a bird, butterfly or other flying insect.

14. A display unit according to claim 8 further including means for releasably securing said flying object to said flexible resilient member.

15. An advertising display unit comprising:

a support;

a plant mounted on said support;

a simulated flying insect;

and means mounted on said support and connected to said insect and operable to effect movement of said insect in an undulating and reversible orbit relative to said plant, said means comprises:

an electric motor comprising a stator and a rotor;

and an elongated, small-diameter, flexible, resilient member secured between said rotor and said flying insect;

said motor being operable in response to a predetermined load imposed on said rotor by said movement of said flying insect to effect reversal in the direction of rotation of said rotor and said flying insect.

16. A display unit simulating a flying object orbiting relative to a stationary object comprising:

a support;

a relatively stationary member mounted on and extending upwardly from said support;

an alternating current electric motor comprising a stator mounted on said support and a rotatable rotor having an axis of rotation;

an elongated, small-diameter, flexible, resilient member secured to said rotor and extending upwardly therefrom adjacent but laterally displaced from said stationary member;

and a flying object secured to said flexible resilient member near the upper end thereof, said flying object having a weight sufficient to cause said flexible resilient member to flex;

said motor being operable to rotate said flexible resilient member and effect motion of said flying object along an orbital path around said axis of rotation, which path randomly varies in diameter and randomly undulates relative to said support, whereby said flying object can randomly strike said stationary member and randomly move relative to said axis of rotation, said motor being further operable, when a predetermined load is imposed on said rotor as a result of said flying object randomly striking said stationary object or randomly moving to effect a reversal in the direction of rotation of said rotor and said flying object.

17. A display unit according to claim 16 wherein said stationary member takes the form of a plant and wherein said flying object takes the form of a flying animated creature, such as a butterfly, hummingbird, insect or the like.

18. A display according to claim 16 or 17 wherein said stator comprises an electric field coil which, when energized, provides a rotating magnetic field and wherein said rotor comprises a rotatable permanent magnet disposed in said rotating magnetic field and which undergoes a reversal in direction of rotation when subjected to a predetermined load which causes it to shift out of phase with said rotating magnetic field.

19. A display unit simulating a flying insect or the like, and comprising:

a support;

an alternating current electric motor mounted on said support and having a stationary shaft extending in a generally upwardly direction;

a permanent magnet forming part of a rotor of said electric motor removably mounted on said shaft for rotation on said shaft reversibly in either direction;

a thin wire of small diameter secured to said magnet and extending upwardly therefrom for being reversibly and rotatably driven with said magnet;

and a simulated insect or the like, secured to the upper end of said wire, whereby when said simulated insect is drivingly and reversibly rotated it assumes a flying motion in a wide swinging and fluttering action.

20. A display unit as set forth in claim 19 further characterized in that the uppermost end of said wire has a mounting pad fixed thereto, a low tack adhesive on said pad, whereby said insect can be easily removably attached to said pad.

21. A display unit as set forth in claim 19 wherein said support has a central bore defining a vertically extending opening, said motor being removably mounted in said opening and having sponge-like pad means around its periphery for engagement with the wall of said bore to cushion said motor in said opening.

22. A display unit as set forth in claim 19 further characterized in that said support is a simulated flowerpot formed of Styrofoam, including flowers inserted in said flowerpot and located around said motor, whereby said insect swings around said flowers and can occasionally contact said flowers to cause an impedance to their movement to consequently cause said motor rotor rotation to be reversed with corresponding rotational reversal of the swinging of said insect.

23. A display unit set forth in claim 19 wherein an occasional rotational impedance of said insect is caused by the weight of said insect as it is trailingly rotated by said rotor magnet and thereby causes the electric motor to reverse its direction and thereby reverses the rotation of said rotor magnet and said insect attached thereto.

24. A point-of-purchase display unit simulating a flying insect or the like, and comprising:

a simulated flowerpot support formed of Styrofoam for said display, said support defining an unpwardly facing opening, an alternating current electric motor mounted in said opening, said motor having a stationary shaft extending in a generally upwardly direction, a permanent magnet forming a rotor in said motor removably mounted on said shaft for rotation on said shaft and reversibly drivable in either direction by said alternating current motor, a thin wire of a small diameter secured to said magnet and extending upwardly therefrom for being reversibly and rotatably driven with said magnet, and a simulated insect or the like secured to the upper end of said wire, whereby when said simulated insect is drivingly and reversibly rotated, said insect assumes a rotationally reversible flying motion in a wide swinging and fluttering action, and when an impedence to the movement of said insect occurs, said motor is caused to reverse its rotational direction and thereby cause reversal of rotational direction of said insect.

25. The display as set forth in claim 24 further characterized in that the uppermost end of the wire has a mounting pad fixed thereto, a low tack adhesive on said pad, whereby said insect can be easily removably attached to said pad.

26. The display as set forth in claim 24 wherein said support has a central bore defining a vertically extending opening, said motor being removably mounted in said opening and having sponge-like pad means around its periphery for engagement with the walls of said bore to cushion said motor in said opening.

* * * * *